United States Patent [19]

Shastal

[11] Patent Number: 4,969,574

[45] Date of Patent: Nov. 13, 1990

[54] CONTAINER CLOSURE

[76] Inventor: Eugene D. Shastal, 1149 SE. Coral Reef St., Port St. Lucie, Fla. 34983

[21] Appl. No.: 394,711

[22] Filed: Aug. 16, 1989

[51] Int. Cl.[5] ..... B65D 17/34

[52] U.S. Cl. ..... 220/269; 220/335; 220/339; 215/235; 215/253

[58] Field of Search ..... 220/268, 269, 335, 339; 215/235, 250, 253, 254

[56] References Cited

U.S. PATENT DOCUMENTS

| | | | |
|---|---|---|---|
| 4,291,818 | 9/1981 | Nozawa et al. | 220/335 |
| 4,516,689 | 5/1985 | Barker | 220/335 |
| 4,687,116 | 8/1987 | Dutt et al. | 220/270 |
| 4,700,858 | 10/1987 | Bennett | 220/335 X |
| 4,736,858 | 4/1988 | Shastal | 215/236 |
| 4,775,065 | 10/1988 | Shastal | 215/235 |
| 4,892,217 | 1/1990 | Shastal | 220/269 X |
| 4,895,298 | 1/1990 | Reil | 220/269 X |

*Primary Examiner*—Stephen Marcus
*Assistant Examiner*—Nova S. Tucker
*Attorney, Agent, or Firm*—Wood, Phillips, Mason, Recktenwald & VanSanten

[57] ABSTRACT

A tamper-resistant dispensing structure including a closure for selectively closing an opening in a wall forming a portion of a container. Retaining structure is provided for maintaining the closure in association with the wall and with a stopper portion thereof maintained suitably for accurate fit with the opening in the wall during a closing operation. A flange is provided on the container for controlling the lateral disposition of the closure on the wall. In one form of the closure, the container flange is turned to cause the distal end thereof to retain the periphery of the closure against the wall.

17 Claims, 1 Drawing Sheet

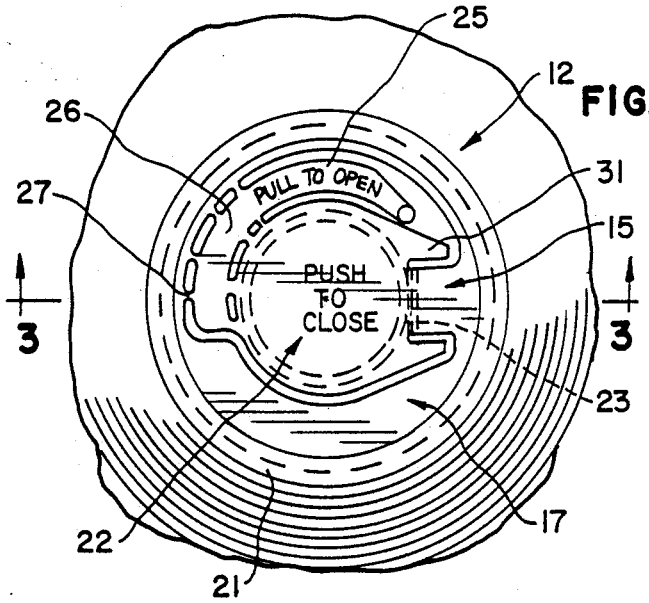
FIG. 1
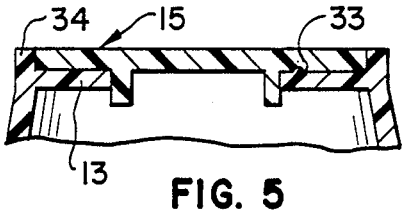
FIG. 5
FIG. 2
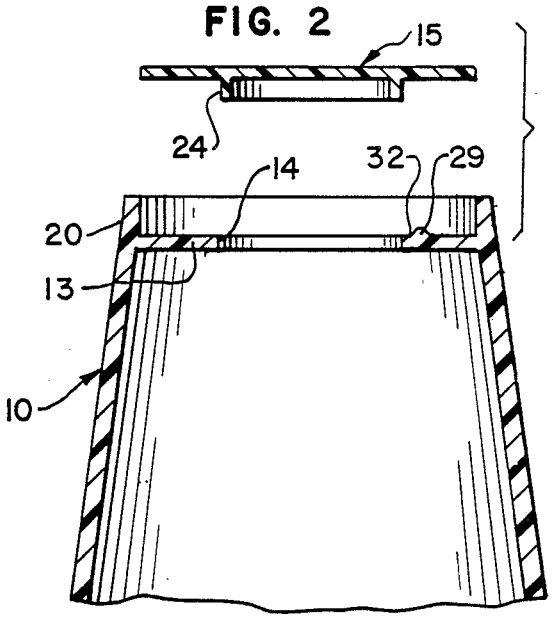
FIG. 3
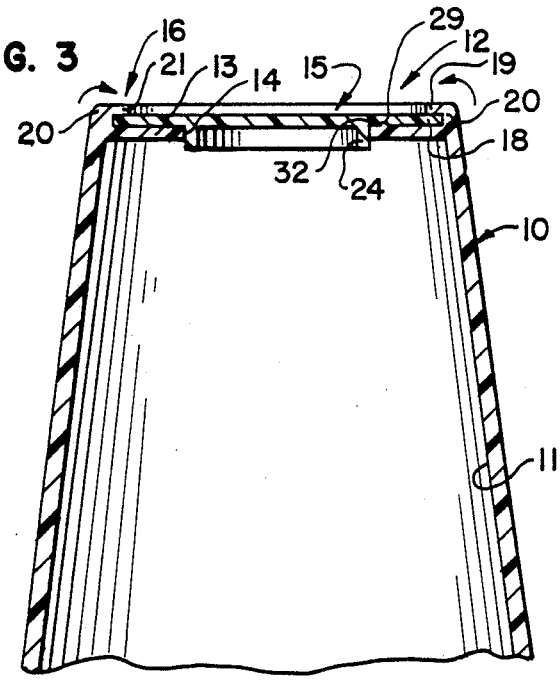
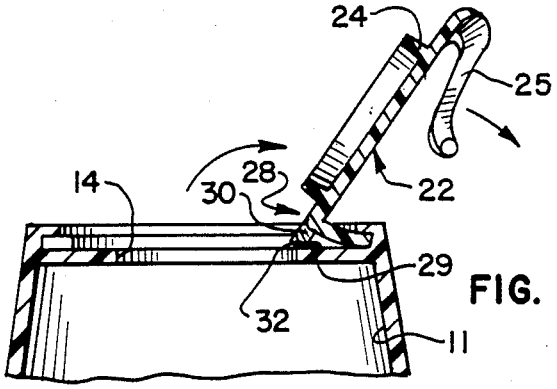
FIG. 4

CONTAINER CLOSURE

TECHNICAL FIELD

This invention relates to container closures and, in particular, to closures having a selectively positionable stopper for controlledly closing an opening in the container wall.

BACKGROUND ART

A number of different closures for selectively closing an opening in a container wall are known in the are. Two excellent examples of such closures are those shown in my U.S. Pat. Nos. 4,736,858 for A Selectively Closable Container Closure and No. 4,775,065 for A Tamper-Resistant Dispensing Closure.

In these U.S. patents, an insert is provided having a through opening to the container space. The closure further includes a base element which is secured to the container wall and acts to retain the insert on the container wall inwardly of a control element which is swingably mounted to the base element for selectively disposing a stopper portion in the opening of the insert.

It is also known to mount a closure on a container wherein the container wall defines the opening, thus eliminating the need for the separate insert. One such closure structure is shown in Takamitsu Nozawa et al U.S. Pat. No. 4,291,818.

DISCLOSURE OF INVENTION

The present invention comprehends an improved tamper-resistant dispensing structure including a closure having a stopper portion adapted for selective closing of an opening provided in a wall defining a container for material to be dispensed through the opening.

The invention comprehends providing first retaining means on the wall acting against an outer surface of a peripheral portion of a base element of the closure for retaining the base element on the wall and maintaining the stopper portion positioned so as to be disposed in alignment with the wall opening when returned to the closed position.

The dispensing structure of the present invention further includes second retaining means including cooperating interlocked means and cooperating overcenter means on the closure and wall for conjointly retaining the closure selectively in an open position, wherein the stopper portion is spaced from the wall opening.

In the illustrated embodiment, the first retaining means comprises a turned flange upstanding from the wall and having a distal end abutting the outer surface of the base element. As shown in the drawing, the flange may comprise an annular turned flange extending fully about the peripheral portion of the base element.

In the illustrated embodiment, the wall is formed of synthetic resin and the flange is formed integrally with the wall.

The invention comprehends that the first retaining means have a preselected retention strength within the same order of magnitude as the force required to displace the control element from the base element and withdraw the stopper portion from the opening.

The invention further comprehends that the first retaining means have a preselected retention strength within the same order of magnitude as the force required to break the means frangibly connecting the control element of the closure to the base element thereof during initial withdrawal of the stopper portion from the wall opening.

Alternative forms of such retaining means, within the broad scope of the invention, include adhesive means and weld means, such as sonic weld means and thermal weld means.

The invention further comprehends the provision of retaining means disposed within the periphery of the wall for retaining the base element in direct facial abutment with the wall and with the stopper portion of the control element positioned so as to be disposed in alignment with the wall opening when brought to the closed position.

The tamper-resistant dispensing structure of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary plan view of a tamper-resistant dispensing structure embodying the invention;

FIG. 2 is a exploded vertical diametric section thereof;

FIG. 3 is a diametric section taken substantially along the line 3—3 of FIG. 1;

FIG. 4 is a fragmentary diametric section similar to that of FIG. 3, but with the closure in an open position; and FIG. 5 is a fragmentary diametric section illustrating another form of dispensing structure embodying the invention.

BEST MODE FOR CARRYING OUT THE INVENTION

In the illustrative embodiment of the invention as disclosed in FIGS. 1–4 of the drawing, a container generally designated 10, defining an interior storage space 11, is provided with a tamper-resistant dispensing structure generally designated 12.

Container 10 defines a wall 13 having a through opening 14 through which material from space 11 may be dispensed. In the illustrated embodiment, the wall 13 defines one end of the container and is generally circular. As will be obvious to those skilled in the art, the wall may have any desired configuration within the broad scope of the invention.

A closure generally designated 15 is retained on the wall 13 by a first retaining means generally designated 16. The closure includes a base element having a peripheral portion 18 defining an outer surface 19. In the illustrated embodiment, first retaining means 16 comprises an annular flange 20 having a turned, distal end 21 overlying and abutting the outer surface 19 of wall peripheral portion 18 for securing the closure on the wall 13.

Closure 15 further includes a control element generally designated 22 swingably mounted to the base element at a hinge portion 23. The control element includes a stopper portion 24 adapted to be received in the wall through opening 14, in a closed position of the closure, as shown in FIG. 3.

The control element further includes a manipulating portion 25 extending outwardly from the stopper portion and being adapted to be engaged by a user's fingers for withdrawing the stopper portion from the wall opening and permitting the control element to be swung to an open position wherein the stopper portion is spaced from the wall opening to permit dispensing of material from the container space 11, as desired, as shown in FIG. 4.

The manipulating portion includes a connecting portion 26 which is removably connected to the base element by readily observable frangible connecting bridges 27. As seen in FIG. 1, the bridges permit withdrawal of the stopper portion from the opening only in the event that they are observably broken, as during the first opening of the closure. Once the bridges are broken, observation thereof is permitted so as to indicate to a subsequent user of the dispensing structure that the dispensing structure has been previously opened.

Flange 20 further defines retaining means for maintaining the base element centered relative to the wall opening 14 and thereby maintaining the stopper portion of the closure element positioned so as to be disposed in alignment with the wal opening when the closure element is returned to the closed position of FIG. 3.

The closure further includes a second retaining means generally designated 28 including interlock means 29 defined by an upstanding detent on wall 13 adjacent opening 14 and cooperating overcenter means on the closure and wall including cantilevered legs 31 on the closure element and an upper surface 32 on the wall adjacent opening 14 inwardly of the detent 29 for conjointly retaining the closure in the opened position of FIG. 4, such as during a dispensing operation.

In the illustrated embodiment, the container 10, including wall 13, is formed of a synthetic resin and, as shown, flange 20 is formed integrally with the container wall.

First retaining means 16 has a preselected strength within the same order of magnitude as the force required to break the frangible means during the initial withdrawal of the stopper portion from the wall opening and subsequently to displace the control element from the base element in withdrawing the stopper portion from the opening in moving from the closed to the open position.

In lieu of the turned flange first retaining means 16, the base element may be secured to the wall 13 by securing means 33, as illustrated in FIG. 5. As shown therein, the closure 15 is retained against lateral displacement by the upstanding flange 34. Securing means 33 is provided for retaining the base element on the wall 13 and, illustratively, may comprise adhesive means, weld means including sonic and thermal weld means, bonding means, etc. As will be obvious to those skilled in the art, the base element may be secured to the wall by other suitable securing means, such as mechanical fasteners, etc., within the broad scope of the invention.

In the illustrated embodiment, the retaining means for retaining the base element in direct facial abutment with the wall is disposed within the periphery of the wall. In the illustrated embodiment as discussed above, the peripheral wall comprises an annular edge portion thereof and the container may be provided with an upstanding flange disposed outwardly of the periphery of the wall for positioning the closure on the wall. In the illustrated embodiment as discussed above, the flange comprises an annular flange extending fully about the periphery.

Thus, the invention comprehends an improved reclosable closure having improved means for retaining the closure in association with a all forming a portion of a container and having a pouring opening therein selectively closed by a stopper portion of the closure when the closure is dispose selectively in a closed disposition. Improved structure is provided for maintaining accurate alignment of the stopper portion of the closure with the wall opening, and for retaining the closure in association with the wall opening in a simple and economical manner.

The strength of the retaining means is correlated with the different forces generated in initially opening the closure and with the opening and closing of the closure in normal use.

The foregoing disclosure of specific embodiments is illustrative of the broad inventive concepts comprehended by the invention.

I claim:

1. A tamper-resistant dispensing structure comprising:

a wall defining a space for containing material to be dispensed, said wall having a through opening defining a dispensing passage;

a closure including a base element, and a control element swingably mounted to the base element and having a stopper portion adapted to be received in the wall through opening when the control element is disposed in a first, closed position, said control element further having a manipulating portion extending outwardly from the stopper portion and being adapted to be engaged by a user's fingers for withdrawing the stopper portion from the opening, the control element being integrally connected to the base element by readily observable frangible connecting means permitting withdrawal of the stopper portion from the opening only in the event the connecting means are observably broken, said base element defining a peripheral portion defining an outer surface;

first retaining means on said wall acting against said peripheral portion outer surface for retaining the base element o the wall and maintaining the stopper portion positioned so as to be disposed in alignment with the wall opening when returned to the closed position; and second retaining means including cooperating interlock means and cooperating overcenter means on said closure and wall for conjointly retaining the closure selectively in an open position wherein the stopper portion is spaced from said wall opening.

2. The tamper-resistant dispensing structure of claim 1 wherein said first retaining means comprises a turned flange upstanding from said wall and having a distal end abutting said outer surface of the base element.

3. The tamper-resistant dispensing structure of claim 1 wherein said first retaining means comprises an annular turned flange upstanding from said wall and having a distal end abutting said outer surface of the base element.

4. The tamper-resistant dispensing structure of claim 1 wherein said wall is formed of synthetic resin and said first retaining means comprises a turned flange upstanding from said wall and having a distal end abutting said outer surface of the base element, said flange being formed integrally with said wall.

5. The tamper-resistant dispensing structure of claim 1 wherein said first retaining means has a preselected retention strength within the same order of magnitude as the force required to displace said control element from said base element and withdraw the stopper portion from said opening.

6. The tamper-resistant dispensing structure of claim 1 wherein said first retaining means has a preselected retention strength within the same order of magnitude as the force required to break said frangible means during the initial withdrawal of said stopper portion from the wall opening.

7. A tamper-resistant dispensing structure comprising:

a wall defining a space for containing material to be dispensed, said wall having a through opening defining a dispensing passage;

a closure including a base element, and a control element swingably mounted to the base element and having a stopper portion adapted to be received in the wall through opening when the control element is disposed in a first, closed position, said control element further having manipulating portion extending outwardly from the stopper portion an being adapted to be engaged by a user's fingers for withdrawing the stopper portion from the opening, the control element being integrally connected to the base element by readily observable frangible connecting means permitting withdrawal of the stopper portion from the opening only in the event the connecting means are observably broken, said base element defining a peripheral portion defining an outer surface;

first retaining means for retaining said peripheral portion of the base element against s id wall and maintaining the stopper portion positioned so as to be disposed in alignment with the wall opening when returned to the closed position; and second retaining mean including cooperating interlock means and cooperating overcenter means on said closure and wall for conjointly retaining the closure selectively in an open position wherein the stopper portion is spaced from said wall opening.

8. The tamper-resistant dispensing structure of claim 7 wherein said first retaining means comprises adhesive means.

9. The tamper-resistant dispensing structure of claim 7 wherein said first retaining means comprises weld means.

10. The tamper-resistant dispensing structure of claim 7 wherein said first retaining means comprises sonic weld means.

11. The tamper-resistant dispensing structure of claim 7 wherein said first retaining means comprises thermal weld means.

12. The tamper-resistant dispensing structure of claim 7 wherein said means for retaining the stopper portion positioned comprises means upstanding from said wall.

13. The tamper-resistant dispensing structure of claim 7 wherein said means for retaining the stopper portion positioned comprises an annular Projection upstanding from said wall.

14. A tamper-resistant dispensing structure comprising:

a wall defining a space for containing material to be dispensed, said wall having a through opening defining a dispensing passage;

a closure including a base element, and a control element swingably mounted to the base element and having a stopper portion adapted to be received in the wall through opening when the control element is disposed in a closed position, said control element further having a manipulating portion extending outwardly from the stopper portion and being adapted to be engaged by a user's fingers for withdrawing the stopper portion from the opening, the closure being integrally connected to the base element by readily observable frangible connecting means permitting withdrawal of the stopper portion from the opening only in the event the connecting means are observably broken, said wall defining an outer periphery; and retaining means disposed within said periphery of the wall for retaining the base element in direct facial abutment with the wall and with the stopper portion positioned so as to be disposed in alignment with the wall opening when returned to the closed position.

15. The tamper-resistant dispensing structure of claim 14 wherein said periphery of the wall comprises an annular edge portion thereof.

16. The tamper-resistant dispensing structure of claim 14 wherein said periphery of the wall comprises an annular edge portion thereof having an upstanding flange outwardly of said base element.

17. The tamper-resistant dispensing structure of claim 14 wherein said periphery of the wall comprises an annular edge portion thereof having an upstanding annular flange outwardly of said base element.

* * * * *